United States Patent [19]

Vaudaux

[11] 4,072,321

[45] Feb. 7, 1978

[54] LOST MOTION ANCHOR FOR A SELF-RESTORING SKI BINDING

[75] Inventor: Francis Vaudaux, Boege, France

[73] Assignee: The Garcia Corporation, Teaneck, N.J.

[21] Appl. No.: 680,859

[22] Filed: Apr. 27, 1976

[30] Foreign Application Priority Data

May 2, 1975 France ..... 75 13803

[51] Int. Cl.[2] ..... A63C 9/00

[52] U.S. Cl. ..... 280/637; 280/613; 280/618

[58] Field of Search ..... 280/637, 613, 618, 611, 280/623

[56] References Cited

U.S. PATENT DOCUMENTS 3,893,682 7/1975 Weinstein et al. ..... 280/637

FOREIGN PATENT DOCUMENTS 2,520,898 12/1975 Germany ..... 280/613

*Primary Examiner*—Joseph F. Peters, Jr.
*Assistant Examiner*—Milton L. Smith
*Attorney, Agent, or Firm*—Fitzpatrick, Cella, Harper & Scinto

[57] ABSTRACT

In a releaseable skin binding of the type wherein a sole-plate is operatively connected to the ski by means of at least one tensioned cable, there is provided a cable anchor mounted to the ski which includes a lost-motion connection.

12 Claims, 7 Drawing Figures

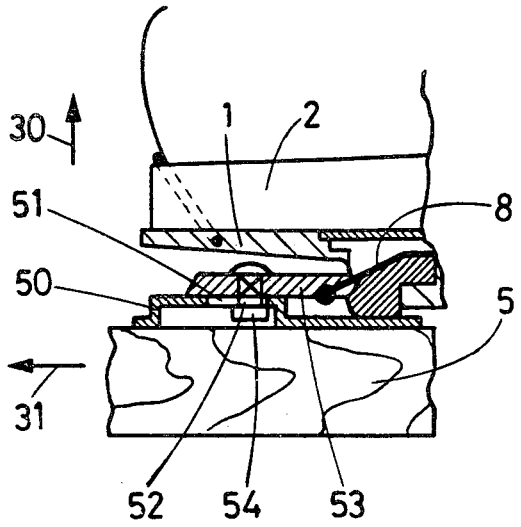
FIG. 5
FIG. 6
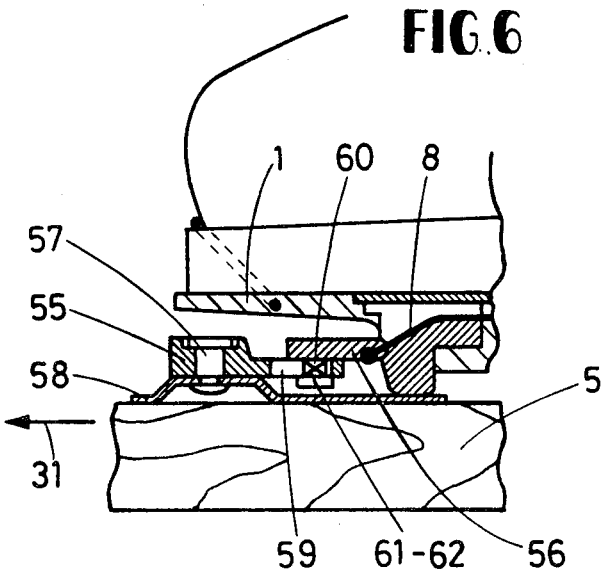
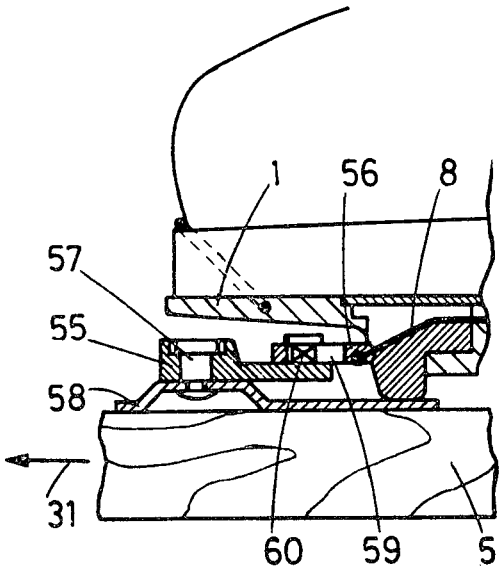
FIG. 7

LOST MOTION ANCHOR FOR A SELF-RESTORING SKI BINDING

BACKGROUND OF THE INVENTION

The present invention relates generally to a release ski binding of the type having a sole plate that can be fastened under the sole of a boot for skiing; the extremities of said plate being constantly urged toward the ski by one or more flexible connections such as cables, subjected at all times to the action of one or more elastic tension devices. More particularly, the distal end of at least one of the flexible connections is fastened to the ski by means of a hooking head which is slidably and pivotally mounted on the ski around a spindle that is anchored roughly perpendicular to the upper surface of the latter. The end of the plate is kept locked during skiing against this head.

In a known ski binding of this type, the cable is anchored directly to a spindle or axis. When a minimum pre-set force is exerted upward by the boot on the plate, it is necessary that the end of the plate which is locked under an inclined edge of the hooking head of the anchor free itself from said edge and be able to move upward in relation to the ski. For this purpose, the plate has to move away from the hooking head. However, this movement tends to be prevented not only by the tension of the cable that connects the plate to the pivoting head, but also by a component of the tension of the second cable that connects the opposite end of the plate to the ski. Therefore, the positioning of anchor of the second cable on the ski is very important because a poor positioning is liable to disturb the release of the first end of the plate by increasing or decreasing the amount of force necessary for such release. The fact is that such a positioning is difficult to achieve, because it is done without the possibility of adjustment at the time that the binding is installed on the ski.

Also, when a minimum pre-set force is exerted laterally by the boot on the plate, it is necessary that the end of the plate be able to release and move laterally with respect to the ski. In the past, the end of the plate had a recess in the center, shaped in such a way that it fit on either side of the pivoting head. Since the lateral releasing force must be three or four times less than the upward releasing force, the width of this recess was relatively small because a greater width would produce an arching of the lateral parts of the pivoting head on the lateral parts of the recess of the plate so that the latter would move back considerably, which would require an increase in the minimum release force. As a result of this relatively small width of the recess in the plate, the plate is maintained in position against the pivoting head by relatively close points of support. In view of the lnormal amount of play inherent in manufacturing operations, it has heretofore been difficult to obtain a very good lateral stability of the plate on the ski during skiing.

Furthermore, after upward and/or lateral release, the plate should be able to resume its place automatically on the ski, with its front extremity coming back to lock against the pivoting head under the action of the cable connecting it to the head. However, this return to a skiing position is sometimes disrupted because of the tension of the rear connection, and also of the front connection, that tend to return the plate too rapidly. In such cases the end of the plate strikes against the upper part of the pivoting head; and in order for locking to be able to take place, the plate has to move back against the tension of the two cables which occasionally does not occur due to the inertia of the plate and of the skier that it supports, said inertia often tending to pull the plate in the direction of the pivoting head.

The ski binding according to the present invention makes it possible to avoid these prior problems. It permits a release in all directions and an automatic return of the plate onto the ski once the force that produced the release ceases to be applied, with the end of the plate always locking against the head automatically, without the plate having to move away from the pivoting head for this purpose. Furthermore, the recess in the plate's extremity can be given greater dimensions and in particular a greater width, so that the points of support of the plate and pivoting head can be placed further apart. This permits greater lateral stability of the plate during skiing, without this greater distance in the supporting points interfering with the release of the plate or with its return to a locked position. Finally, the ski can bend longitudinally during skiing, and this flexing likewise does not interfere with the release or locking of the plate.

SUMMARY OF THE INVENTION

The ski binding of the present invention includes a sole plate to which the sole of a ski boot is releaseably secured, the extremities of said plate being constantly urged against the ski by one or more flexible connections such as cables subjected to the constant action of at least one elastic tension device supported by the plate or by the ski. The distal end of the cable connecting one of the extremities of the plate to the ski is fastened to a hooking head which is slidably and pivotally mounted on the ski around a shaft perpendicular to the upper surface of the latter. The end of the plate is kept locked against this head, both vertically and transversally. The binding of the invention further includes means that resists the axial displacement of the plate on the ski; said means may be either one or more stationary stops, or one or more suitably oriented inclines, or more simply the component of the tension of the flexible connection holding the other end of the plate elastically on the ski. Unlike bindings in the prior art, the release ski binding which is the object of the invention includes guide means which translates motion of at least part of the head, to a direction that moves the hooking point of the cable away from the end of the plate, at least during the unlocking and relocking of the plate and the head.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 5 is a partially sectional view of a second form of embodiment of the invention;

FIG. 6 is a partially sectional view of a third form of embodiment of the invention; and FIG. 7 is a partially sectional view of a variant of the third embodiment of the invention.

DETAILED DESCRIPTION

Figure 1:
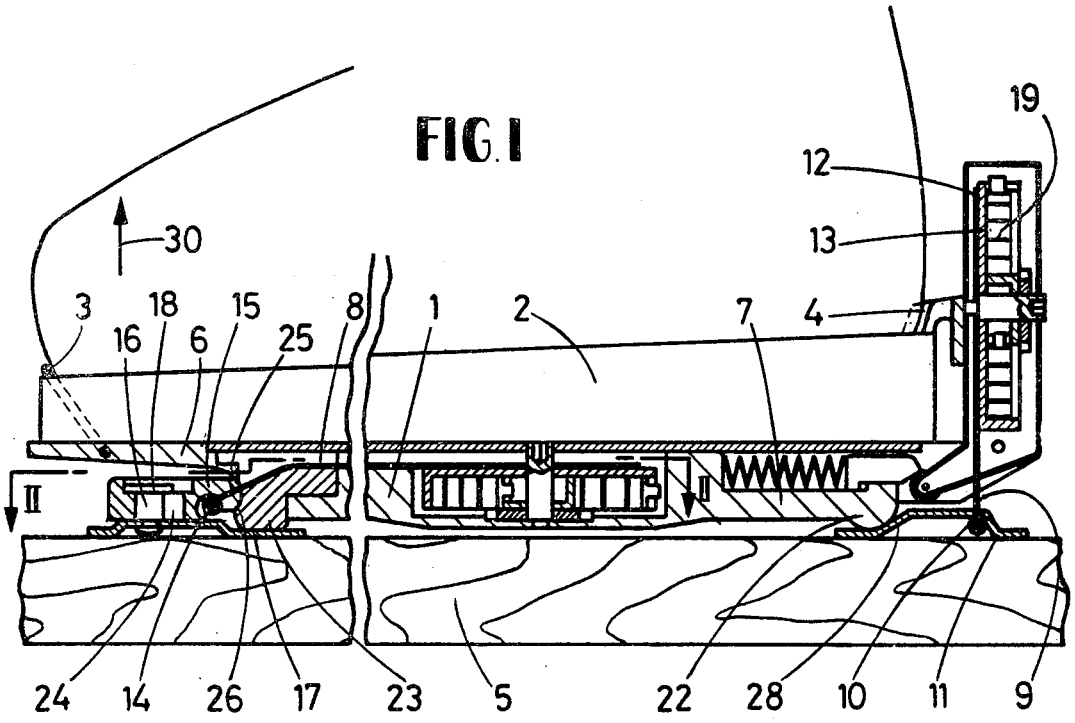
FIG. 1 illustrates a first form of the invention seen in section taken along line I—I of FIG. 2.
Figure 2:
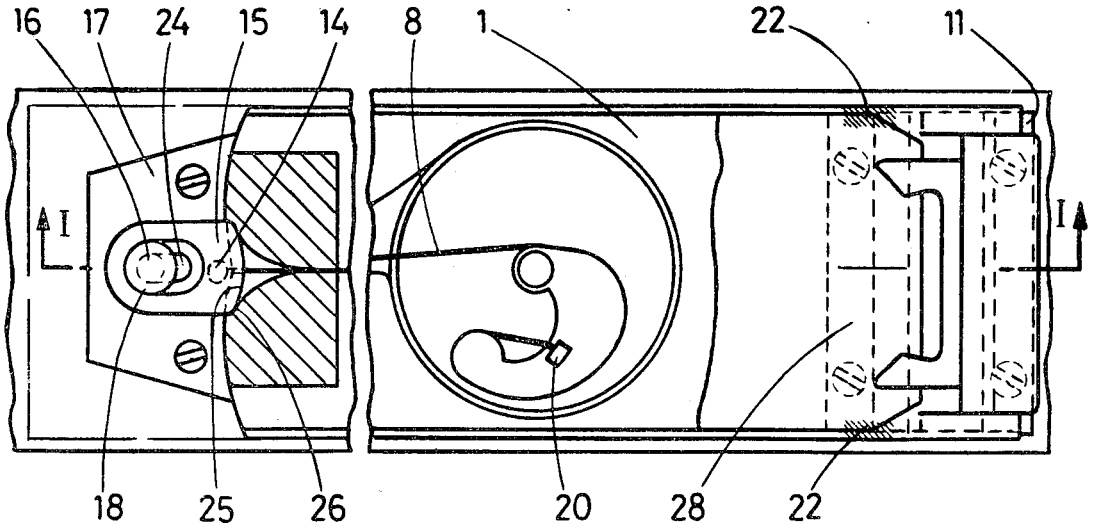
FIG. 2 is a partial sectional view taken along line II—II in FIG. 1.

The ski binding as represented in FIGS. 1 and 2 includes a sole plate 1 that can be fastened to the sole of a ski boot 2 through a front hold-down element 3 and a rear hold-down element 4. Plate 1 tends to be held constantly on ski 5 through its front 6 and rear 7 extremities respectively by means of flexible cables 8 and 9. The distal end 10 of cable 9 is hooked to the ski by a fastening plate 11 with its other end 12 placed in a groove, for example in the form of a spiral, which is on the periphery of a winding unit 13 subjected at all times to the action of a spiral spring 19. The distal end 14 of cable 8 is hooked to a head 15 pivotally mounted on a shaft 16 supported by a base plate 17 secured to the top surface of a ski 5. It is presently preferred to provide the distal ends 10 and 14 of cables 9 and 8 respectively with an enlarged head that can be removably inserted in a slot or recess in the fastening plate 11 and head 15. Thus, when it is desired to remove the plate 1 from ski 5 such as for servicing or storage it is necessary only to create slack in the cables and then disengage the ends thereof from the respective anchor.

Shaft 16 is supported perpendicularly to the top surface of the ski 5 and has a head 18 that prevents pivoting head 15 from moving upward in direction 30. The other end 20 of cable 8 is connected to an elastic device similar to the one described for cable 9. Sole plate 1 rests on ski 5 to the rear and to the front respectively through rear 22 and front 23 projecting parts. Pivoting head 15 has a closed oblong slot 24 having a recess and the dimensions of this slot are just sufficient to receive shaft 16 and head 18 and to allow head 15 to slide in relation to the shaft 16.

It is to be understood that the particular winding units and position thereof for exerting a preselected tension on cables 8 and 9 do not form a part of the present invention. Those skilled in the art will readily recognize that the means for tensioning the winding units may take various forms other than the spiral spring 19 as described herein and that such winding units may both be housed in plate 1 or on ski 5.

During skiing, the tension of cable 8 holds the shaped edge 25 of pivoting head 15 resting against the relatively far apart lateral portions of a recess 26 with a conjugate profile, at extremity 6 of plate 1. To keep plate 1 more firmly engaging and always in the same longitudinal position on ski 5, rear fastening plate 11 has an inclined plane 28 against which projecting parts 22 are maintained in contact under the action of winding unit 13. The inclined plane 28, could be replaced by a stationary stop or the plate could, in fact, be positioned longitudinally on ski 5 solely by the tension of cable 9. When plate 1 is in the skiing position as shown in FIGS. 1 and 2, the pivoting head 15 is in the position also shown in FIGS. 1 and 2 with the front end of slot 24 resting approximately against shaft 16. Without going outside the scope of the present invention, slot 24 could be extended forwardly so that its front end would not be in contact with shaft 16 when plate 1 is in the skiing position.

Figure 3:
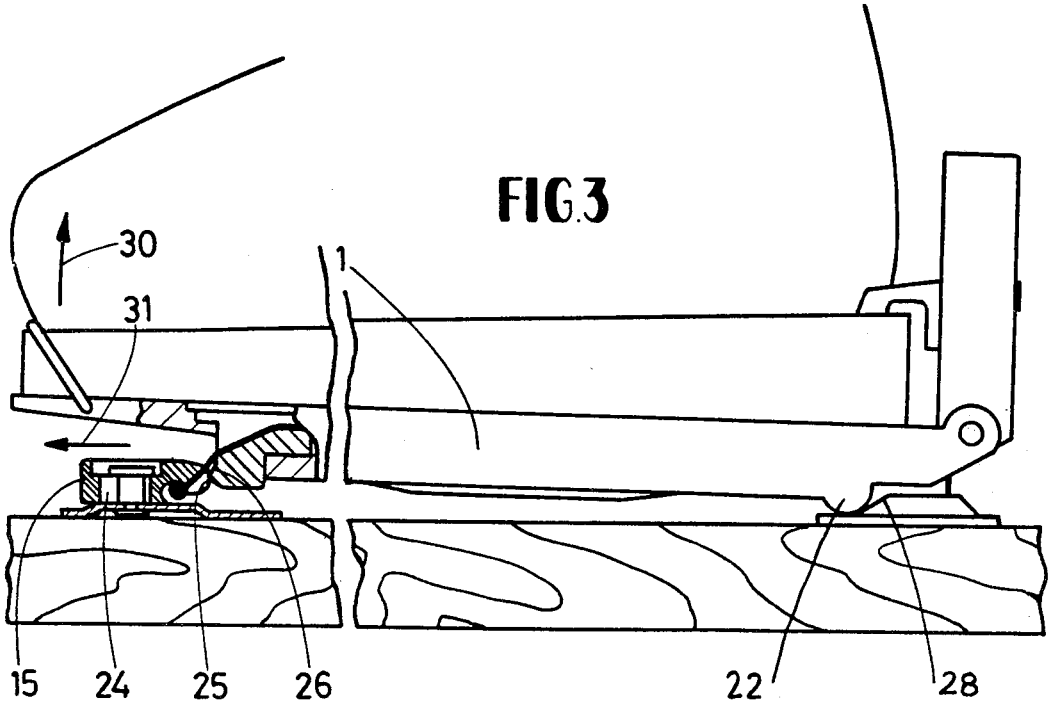
FIG. 3 is a partial sectional view illustrating upward release of the forward portion of the binding of the invention.

When a minimum pre-set force is exerted by the boot along direction 30, as shown in FIG. 3, plate 1 tends to raise up in the same direction. The recess 26, under shaped edge 25 of pivoting head 15, exerts upon this edge a force that tends to move plate 1 and pivoting head 15 from each other. Since plate 1 is prevented from moving rearwardly by the projecting parts 22 that are held by incline plane 28, the pivoting head 15 slides forwardly along direction 31. Plate 1 is thus released and can move away from the ski to fulfill its purpose as a safety device.

When the force that produced the release ceases to be applied, cables 8 and 9 bring back plate 1 to rest on ski 5 under the action of their respective tension devices. During this operation, the shaped lower part of recess 26 strikes the upper part of shaped edge 25 of pivoting head 15 which is then easily pushed forward along direction 31 and plate 1 resumes its position as in FIG. 1. It should be pointed out that if inclined plane 28 did not exist, plate 1 could perhaps move back slightly at the time of the release or of the relocking, even though, since the inertia of pivoting head 15 is less than that of plate 1, it is always pivoting head 15 that moves over a greater distance and more rapidly.

Figure 4:
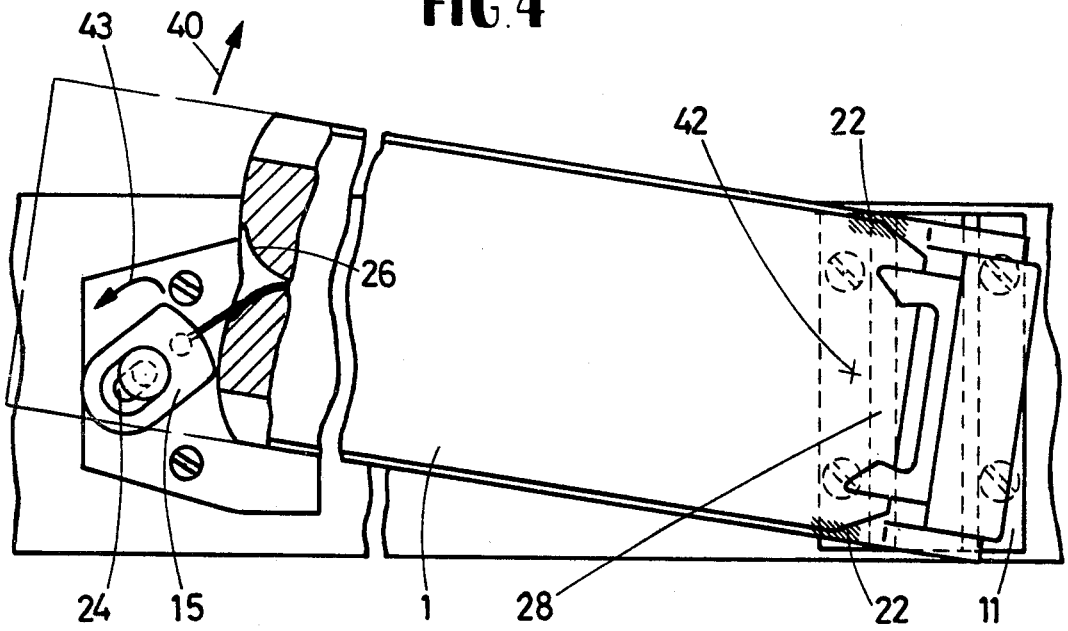
FIG. 4 is a plan view, partially in section illustrating lateral release.

When a minimum pre-set force is exerted by the boot laterally in direction 40 as shown in FIG. 4, plate 1 tends to move laterally in the same direction and to pivot more or less around a vertical axis 42 situated between the supporting parts 22. Recess 26 tends to make pivoting head 15 rotate as shown by arrow 43. Since one of the projecting parts 22 rests momentarily on incline 28, pivoting head 15 alone is able to slide, in a forward direction at the same time that it pivots. Plate 1 is thus released and can move away from the ski to fulfill its purpose as a safety device. When the force that produced the lateral release ceases to be applied, cables 8 and 9 retract bringing plate 1 back to rest against ski 5 under the action of their respective tension devices. During retraction, the extremity of plate 1 and the recess 26 push pivoting head 15 forward until the various elements have resumed the position indicated in FIGS. 1 and 2. It will be noted that in this case also, if inclined plane 28 did not exist, plate 1 could move back slightly at the time of the release or when rocking takes place, without creating any problems as a result. Quite to the contrary, such slight backward movement, which unlike the prior art is not indispensable, can only aid the operation of the safety device.

Although described separately above, those skilled in the art will understand that the binding can release upwardly and laterally at the same time.

FIG. 5 illustrates a second embodiment of the cable anchor to the present invention. This second embodiment has a guide element 50 anchored to ski 5, and on this element there is a closed oblong slot 51 placed axially in relation to ski 5. This slot has dimensions that are just sufficient to receive a shaft 52 on a hooking head 53 to which cable 8 is attached. Head 54 of shaft 52 prevents the upward displacement along direction 30. All of the other elements are identical to those in the first form of embodiment described previously.

The operation of this second form of embodiment is similar to that of the first one. During the unlocking of plate 1 and head 53 and during the relocking of these elements, head 53 moves in direction 31 along slot 51 before resuming the position in FIG. 5, the position for skiing.

FIG. 6 represents a third form of embodiment in conformity with the present invention. This third form of embodiment includes a pivoting hooking head which has two parts 55 and 56 that can move in relation to each other; the first part 55 is pivotally mounted on a shaft 57 anchored to ski 5 through a fastening plate 58 and has a closed slot 59 placed roughly along its longitudinal axis. The second part, 56, to which cable 8 is fastened and against which the extremity of plate 1 is kept locked during skiing, has a part with a conjugate profile to that of slot 59. The part with a conjugate profile consists for example of a part in relief 60 having two opposite parallel surfaces 61 and 62 far enough apart so that it can slide in slot 59. All of the other elements are identical to those in the first form of embodiment, described previously.

The operation of this third form of embodiment is similar to that of the second one. During the unlocking of plate 1 and of part 56 of the head, and during the relocking of these elements, part 56 of the head moves in direction 31 along slot 59 while part 55 of the head may turn around its shaft 57. Head 55–56 then resumes the position in FIG. 6, which is the position for skiing.

FIG. 7 represents a variant of the third form of embodiment. In this variant, slot 59 and the part in relief 60 are reversed, so that slot 59 is placed on the second part 56 of the head and the part in relief 60 is placed on the first part 55 of the head. All of the other elements are identical to those in the third embodiment. The operation of the unit as a whole is identical to the operation of the third form of embodiment.

Without going outside the scope of the present invention, the guiding means for translational motion of part of the head could consist of different means with a conjugate profile from ones just described, said means being provided on both parts of the head.

Thus, the guiding means for translational motion of the second part 56 of the head in relation to the first part 55 could consist of a rectilinear opening, whose section is, for example, a parallelogram, placed along the longitudinal axis of one of the parts of the head; a part in relief, unitary with the other part of the head, is placed in this opening, and said part in relief has the same transversal section as the opening and dimensions just sufficient so that it can slide in the latter. The closed extremities of the slots (extremities that serve as stops and limit the movement of the elements that are movable with respect to each other) are replaced here by a stopping element which is unitary, for example, with the part in relief introduced in the rectilinear opening, such as a transversal pin or a set collar.

What is claimed is:

1. In a ski binding comprising a sole plate; at least one flexible connection connecting an extremity of said sole plate to a ski and at least one elastic tension device associated with said flexible connection and placing a continuous tension thereon for releasably retaining said sole plate on said ski; an improved anchor means for securing said flexible connection to said ski which comprises: a base plate secured to the surface of said ski; a post arranged perpendicularly to said base plate; a head pivotally connecting an end of said flexible connection to said post; and guide means on one of said base plate and said head for permitting rotational and limited longitudinal sliding movement of said head in relation to said base plate as said sole plate moves into and out of position adjacent said head.

2. An improved anchor according to claim 1 wherein said post is secured to said base plate and said guide means is defined by a longitudinal slot in said head, said slot being dimensioned to receive said post, said post including an enlarged head overlying said slot.

3. An improved anchor according to claim 1 wherein said post is secured to said head and said guide means is defined by a longitudinal slot in said base plate, said slot being dimensioned to receive said post, said post including an enlarged head underlying said slot.

4. An improved anchor according to claim 1, wherein said post is secured to said base plate and said head comprises first and second parts interconnected by said guide means, said first part being pivotally mounted to said post and said second part being connected to said flexible connection.

5. An improved anchor according to claim 4 wherein said guide means comprises a post extending from said first part and a longitudinal slot defined by said second part, said post being dimensioned to be received within said slot.

6. An improved anchor according to claim 4 wherein said guide means comprises a post secured to said second part and a longitudinal slot defined by said first part, said post being dimensioned to be received within said slot.

7. An improved anchor according to claim 1 wherein said head has a profile conjugate to the extremity of said sole plate to firmly engage said sole plate in its position of retention on said ski.

8. An improved anchor according to claim 1 wherein said sole plate is connected to said ski at its front and rear extremities by at least one flexible connection and said anchor means secures said flexible connection to said ski adjacent one of said extremities.

9. In a ski binding comprising a sole plate; at least one flexible connection connecting the extremities of said sole plate to a ski and at least one elastic tension device associated with said flexible connection and placing a continuous tension thereon for releasably retaining said plate on said ski; an improved anchor means for securing said flexible connection to said ski which comprises: a post, means for securing said post to said ski in generally perpendicular disposition relative to said sole plate, a head pivotally connecting an end of said flexible connection to said post, said flexible connection releasably retaining said plate in position adjacent to said head and guide means on one of said post securing means and said head constructed and arranged to permit rotational and limited longitudinal sliding movement of at least a portion of said head relative to said plate as said plate moves into and out of position adjacent said head.

10. A ski binding which comprises:

a sole plate;

gripping means arranged on said sole plate for detachably securing the sole of a ski boot thereon;

front and rear flexible cables connecting the extremities of said sole plate to a ski;

at least one elastic tensioning device associated with said sole plate, said tensioning device being constructed and arranged for placing a continuous tension on said cables;

means for securing an end of said rear cable to said ski; and anchor means for securing an end of said front cable to said ski, said anchor means comprising a post, means for securing said post to said ski in generally perpendicular diposition relative to said sole plate, a head pivotally connecting the end of said cable to said post, said head having a profile conjugate to the end of said sole plate, said cable releasably retaining said plate in position adjacent said head, and guide means on one of said post securing means and said head constructed and arranged to permit rotational and limited longitudinal sliding movement of at least a portion of said head relative to said sole plate as said sole plate moves into and out of position adjacent said head.

11. A ski binding according to claim 10 wherein said means securing an end of said rear cable to said ski comprises a rear base plate secured to said ski, said rear base plate including means for securing an end of said rear cable thereto and stop means constructed and arranged to abut a rear extremity of said sole plate.

12. A ski binding according to claim 10 wherein said means securing said post to said ski comprises a base plate secured to said ski, said post being secured to said base plate and said guide means comprises a longitudinal slot in said head, said slot being dimensioned to receive said post and permit limited longitudinal and rotational relative movement therebetween.

* * * * *